US009908691B2

(12) United States Patent
Decker

(10) Patent No.: US 9,908,691 B2
(45) Date of Patent: Mar. 6, 2018

(54) DISPENSER AND SHEET PRODUCT DISPENSING PLATE THEREFOR

(75) Inventor: Kip K. Decker, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 774 days.

(21) Appl. No.: 12/827,393

(22) Filed: Jun. 30, 2010

(65) Prior Publication Data

US 2012/0001014 A1 Jan. 5, 2012

(51) Int. Cl.
*B65D 85/00* (2006.01)
*B65D 69/00* (2006.01)
*B65D 85/672* (2006.01)

(52) U.S. Cl.
CPC ..... *B65D 85/672* (2013.01); *Y10T 428/218* (2015.01); *Y10T 428/24314* (2015.01)

(58) Field of Classification Search
CPC ..... A47K 10/32; B65D 5/725–5/726; B65H 49/08
USPC ..... 206/233, 409; 221/306, 609, 45, 46, 63; 225/46, 52, 56, 53; 242/588.3; 428/136; D6/522
See application file for complete search history.

(56) References Cited

U.S. PATENT DOCUMENTS 2,619,226 A * 11/1952 Adams ..... 221/63
2,677,425 A * 5/1954 Broyles ..... 225/56
3,868,052 A * 2/1975 Rockefeller ..... 225/106
3,986,479 A * 10/1976 Bonk ..... 118/506
4,002,264 A * 1/1977 Marchesani ..... 221/63
4,254,918 A * 3/1981 Huggins ..... 242/573
4,289,262 A * 9/1981 Finkelstein ..... 225/106
4,328,907 A * 5/1982 Beard ..... 221/63
4,524,895 A 6/1985 Lunden
4,534,491 A * 8/1985 Norton et al. ..... 221/63
4,535,912 A 8/1985 Bonk
4,651,895 A * 3/1987 Niske et al. ..... 221/63
4,711,384 A * 12/1987 Harris ..... 225/66
4,763,785 A * 8/1988 Bradley et al. ..... 206/389
4,905,868 A 3/1990 Beane et al.
5,024,349 A * 6/1991 Haenni et al. ..... 221/46
5,516,001 A 5/1996 Muckenfuhs et al.
5,595,786 A 1/1997 McBride, Jr. et al.
5,749,492 A * 5/1998 Petterson ..... 221/1
5,803,249 A 9/1998 Harsanyi, Jr. et al.
6,038,834 A * 3/2000 Haley ..... 53/399
6,158,614 A * 12/2000 Haines et al. ..... 221/63
6,220,435 B1 * 4/2001 Nobile et al. ..... 206/409
(Continued)

FOREIGN PATENT DOCUMENTS

JP 2000-513241 A 10/2000
JP 2001-519188 A 10/2001

OTHER PUBLICATIONS

International Search Report and Written Opinion for PCT/US2011/042149 dated Feb. 21, 2012.

*Primary Examiner* — J. Gregory Pickett
*Assistant Examiner* — Kaushikkumar Desai
(74) *Attorney, Agent, or Firm* — Ram W. Sabnis

(57) ABSTRACT

A dispenser plate includes a plate member having an orifice centrally arranged in the plate member, the orifice including a central portion, a first channel portion having a first channel length extending radially from the central portion, and a second channel having a second channel length extending radially from the central portion, wherein the first channel length is greater than the second channel length.

20 Claims, 7 Drawing Sheets

(56) References Cited

U.S. PATENT DOCUMENTS

| | | | | |
|---|---|---|---|---|
| 6,523,690 | B1 * | 2/2003 | Buck et al. | 206/494 |
| 6,554,156 | B1 * | 4/2003 | Chong | 221/63 |
| 6,607,514 | B2 | 8/2003 | Reese | |
| 6,763,988 | B2 * | 7/2004 | Huang | 225/43 |
| 6,779,662 | B2 | 8/2004 | Dorsey | |
| 6,840,401 | B2 * | 1/2005 | Amundson | 221/56 |
| D504,794 | S | 5/2005 | Sellars | |
| 7,533,846 | B2 | 5/2009 | Sellars et al. | |
| 7,559,434 | B2 * | 7/2009 | Masting | 221/34 |
| 7,806,291 | B2 * | 10/2010 | Anderson | 221/33 |
| 2002/0148748 | A1 | 10/2002 | Pikul | |
| 2004/0251292 | A1 * | 12/2004 | Grebonval et al. | 225/39 |
| 2005/0069665 | A1 * | 3/2005 | Butler, III | 428/36.9 |
| 2006/0138159 | A1 * | 6/2006 | Altuve et al. | 221/45 |
| 2007/0048474 | A1 * | 3/2007 | Butler et al. | 428/36.9 |
| 2007/0163909 | A1 | 7/2007 | Ice | |
| 2008/0017750 | A1 * | 1/2008 | Sellars et al. | 242/597.7 |
| 2010/0108706 | A1 * | 5/2010 | Oman | 221/45 |

* cited by examiner

DISPENSER AND SHEET PRODUCT DISPENSING PLATE THEREFOR

BACKGROUND OF THE INVENTION

The subject matter disclosed herein relates to dispensers for sheet products.

Sheet products may be formed into cylindrical rolls having an inner core. The inner core may be removed, and the sheet product may be dispensed in segments. The segments may be drawn by the user from the center of the sheet product roll.

Drawing segments from the center of a sheet product roll allows a user to easily remove sheet products from a roll while the roll remains stationary.

BRIEF DESCRIPTION OF THE INVENTION

According to one aspect of the invention, a dispenser plate includes a plate member having an orifice centrally arranged in the plate member, the orifice including a central portion, a first channel portion having a first channel length extending radially from the central portion, and a second channel having a second channel length extending radially from the central portion, wherein the first channel length is greater than the second channel length.

According to another aspect of the invention, a dispenser includes a containment portion configured to house a cylindrical roll of sheet product, and a dispenser plate retained by the containment portion, the dispenser plate comprising a plate member having an orifice centrally arranged in the plate member, the orifice including a central portion, a first channel portion having a first channel length extending radially from the central portion, and a second channel having a second channel length extending radially from the central portion, wherein the first channel length is greater than the second channel length.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from a roll or folded arrangement at discrete intervals. Individual sheets may be sized as desired to accommodate the many uses of the sheet products. For example, perforation lines may be formed every 10 inches, or other defined interval, to define a universally sized sheet. Multiple perforation lines may be provided to allow the user to select the size of sheet depending on the particular need.

Figure 1:
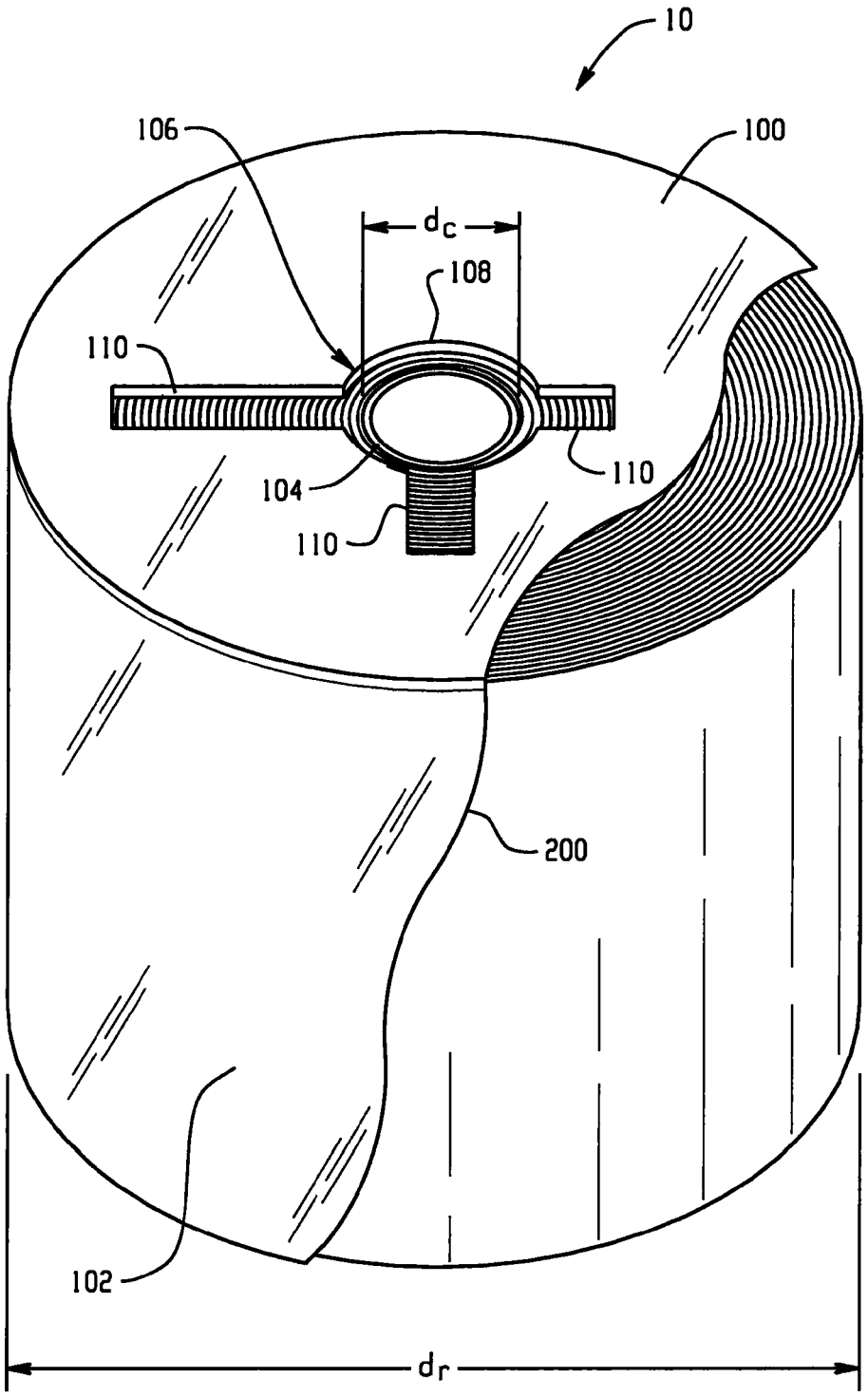
FIG. 1 illustrates a perspective view of an exemplary embodiment of a sheet product dispenser.

FIG. 1 illustrates a perspective view of an exemplary embodiment of a dispenser 10. In the illustrated embodiment, a roll 102 is cylindrically shaped and has a diameter ($d_r$). The roll 102 is formed around a core 104 that may include, for example, a rigid or semi-rigid tubular segment formed from a paper, plastic, or metallic material. The core 104 has a diameter ($d_c$).

The dispenser plate 100 is disposed on an end surface of the roll 102, and may be attached to the roll 102 using any suitable means including, for example, a wrapper film 200 (illustrated as partially cut-away) such as a plastic or polymer film that envelopes the roll 102 and the dispenser plate 100 and exerts a compressive force on the disperser plate 100 and the roll; securing the disperser plate 100 in the illustrated position. In an embodiment, the dispenser plate 100, roll 102, and wrapper film 200 forms a complete dispenser 10. While a wrapper film 200 is disclosed herein forming the containment portion of the dispenser 10, it will be appreciated that the wrapper film 200 may be replaced with a more rigid structure without departing from the scope of the invention disclosed herein.

The dispenser plate 100 may be formed from any suitable material such as a rigid or semi-rigid cardboard material, a plastic, nylon, corrugated, or metallic material. The dispenser plate 100 includes an orifice 106 having a circular portion 108 and a plurality of channels 110 extending radially from the circular portion 108. In the illustrated embodiment, the channels 110 have dissimilar channel lengths such that each channel 110 extends radially from the circular portion 108 exposing portions of the roll 102. Though the illustrated embodiment of FIG. 1 includes three channels 110, alternate embodiments may include any number of channels 110.

Figure 2:
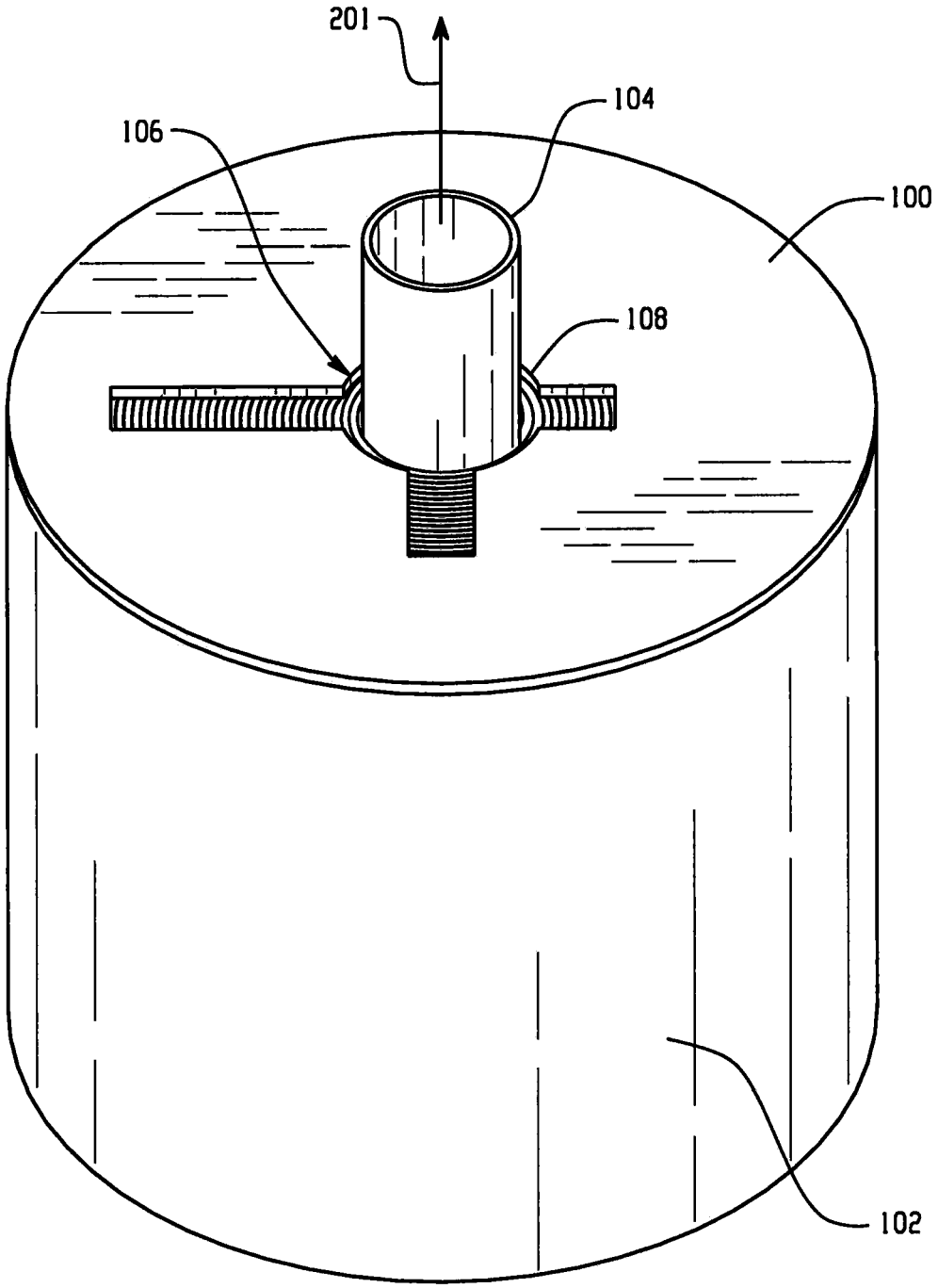
FIG. 2 illustrates another perspective view of the roll and the dispenser plate of FIG. 1.

FIG. 2 illustrates a perspective view of the roll 102 and the dispenser plate 100. In the illustrated embodiment, the core 104 may be removed by a user by exerting a force in the direction of the line 201. The core 104 has an inner diameter that is smaller than the inner diameter of the circular portion 108 of the dispenser plate 100. Once the core 104 is removed, the inner wraps of the roll 102 are exposed.

Figure 3:
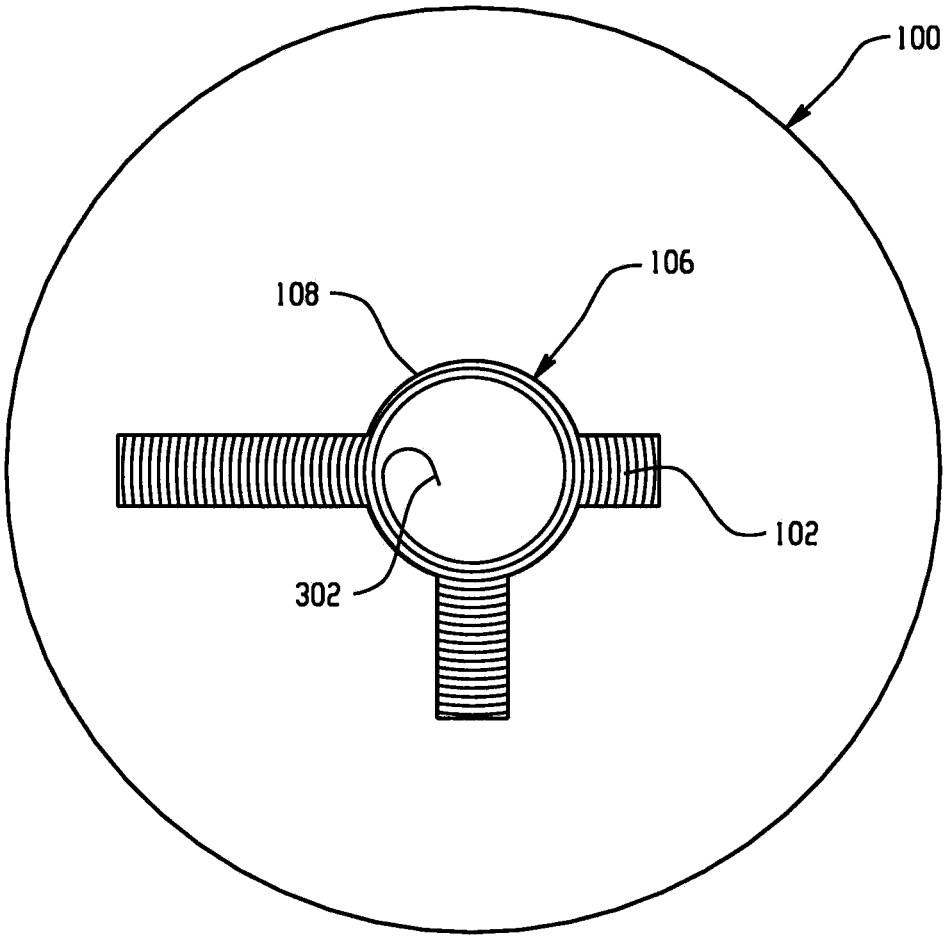
FIGS. 3 and 4 illustrate a top view of the roll and the dispenser plate of FIG. 1.
Figure 4:
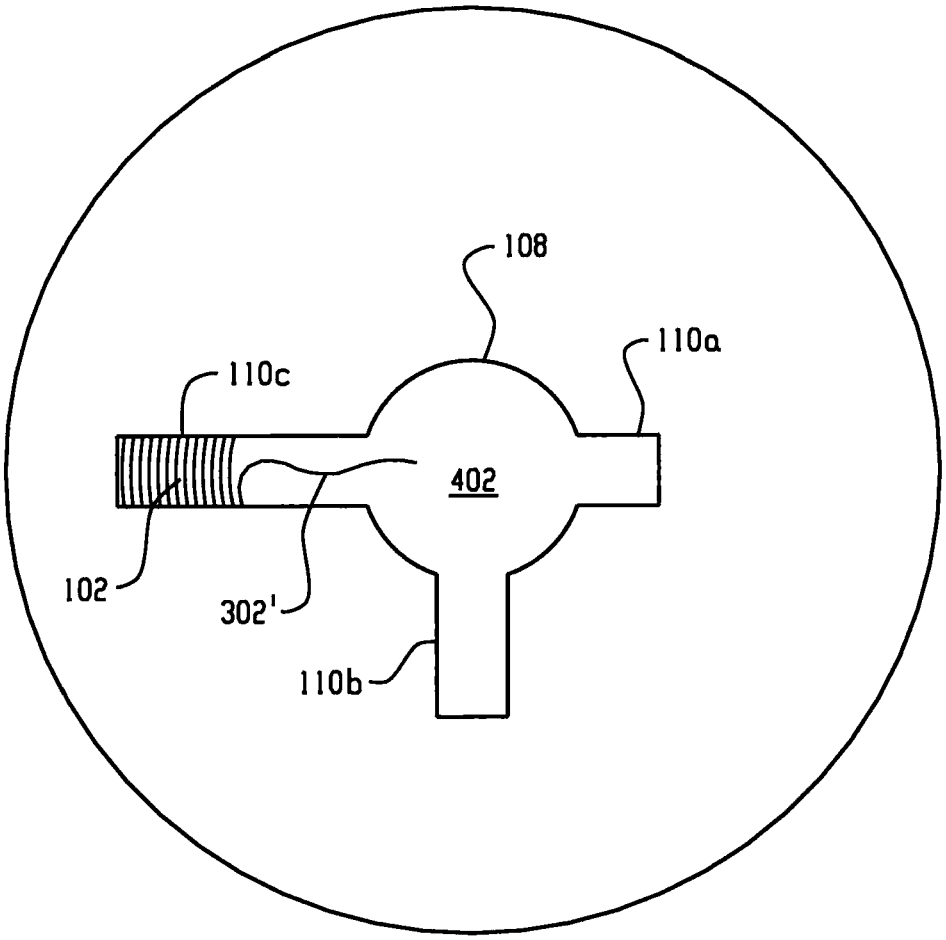

FIGS. 3 and 4 illustrate a top view of the roll 102 and the dispenser plate 100 following the removal of the core 104 (of FIG. 2). Referring to FIG. 3, a user may dispense the sheet product of the roll 102 by pulling a leading edge 302 of the exposed inner wrap and drawing the sheet product through the circular portion 108 of the orifice 106. The user may exert a force radially outward from the circular portion 108 such that a segment of the sheet product contacts an edge of the orifice 106. The contact between the sheet product and the edge of the orifice 106 frictionally facilitates the tearing of the sheet product segment to separate the sheet product segment from the roll 102.

Referring to FIG. 4, as the roll 102 is depleted by subsequent removal of sheet product segments, the remaining portions of the roll 102 remain exposed by the channels 110. The dissimilar lengths of the channels 110 allow portions of the roll 102 to remain exposed as the roll 102 is depleted. For example, in the illustrated embodiment, the channel 110*a* has the shortest length (extending radially from the circular portion 108) relative to the channels 110*b* and 110*c*, while the channel 110*c* has the longest length. As the user removes sheet product from the roll 102, the remaining inner sheets are exposed by the channels 110*a*, 110*b*, and 110*c*. As the user continues to remove sheets from the roll 102 the wraps of the roll 102 define a gradually increasing void 402 in the center of the roll 102. When the void 302 expands beyond the length of the channel 110*a*, a user may still access the roll 102 through the channels 110*b* and 110*c*. In the illustrated embodiment, the void 302 has expanded such that the leading edge 302' of the roll 102 is exposed in the longest channel, channel 110*c*. The use of channels 110 having dissimilar lengths allows a user to access the sheet product of the roll 102 while maintaining rigidity of the dispenser plate 100 since the area of the orifice 106 effects the rigidity of the dispenser plate 100, where a greater orifice 106 area reduces the rigidity of the dispenser plate 100.

Figure 5:
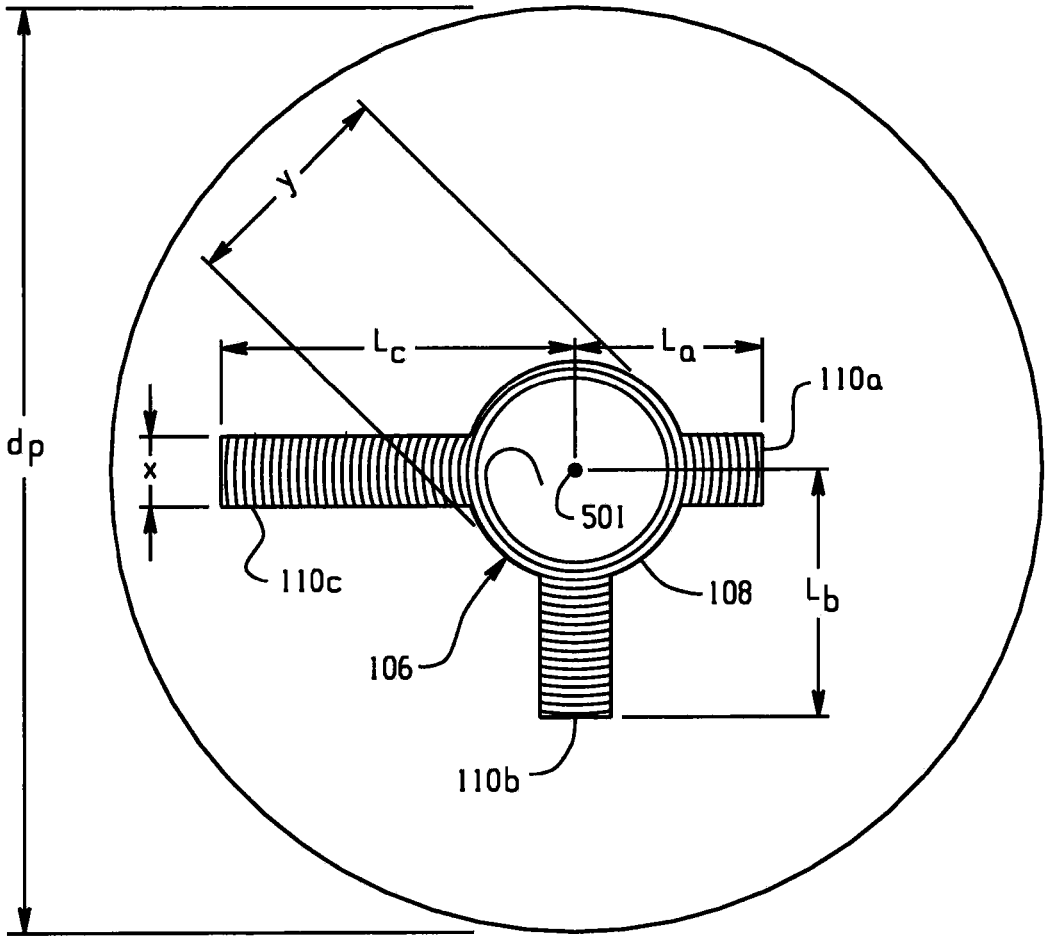
FIG. 5 illustrates another top view of the dispenser plate of FIG. 1.

FIG. 5 illustrates a top view of the dispenser plate 100. The dispenser plate has a diameter ($d_p$). The circular portion 108 of the orifice 106 has a diameter (y). The channels 110*a*, 110*b*, and 110*c* have a similar channel width (x), and dissimilar channel lengths ($L_a$, $L_b$, and $L_c$) respectively; extending radially from a center point 501 of the circular portion 108, where $L_a<L_b<L_c$.

FIGS. 6-13 illustrate top views of alternate exemplary embodiments of dispenser plates that operate in a similar manner as the dispenser plate 100 (of FIG. 1) described above.

Figure 6:
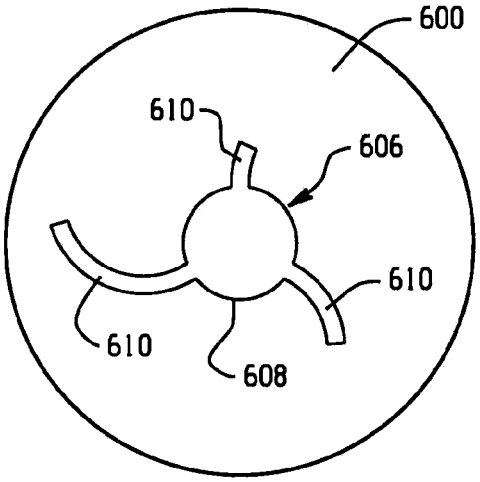
FIGS. 6-13 illustrate top views of alternate exemplary embodiments of dispenser plates.

Referring to FIG. 6, a dispenser plate 600 includes an orifice 606 having a circular portion 608 and channels 610. The channels 610 have an arcuate shaped profile and extend radially from the circular portion with dissimilar lengths in a similar manner as described above.

Figure 7:
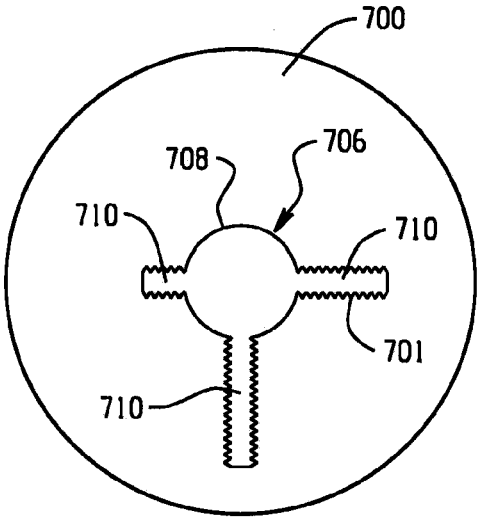

Referring to FIG. 7, a dispenser plate 700 includes an orifice 706 having a circular portion 708 and channels 710. In the illustrated embodiment, the channels 710 include serrated or toothed edges 701 that may facilitate the tearing of a sheet product segment from the roll 102 (of FIG. 1). The channels 710 have dissimilar lengths that extend radially from the circular portion 708.

Figure 8:
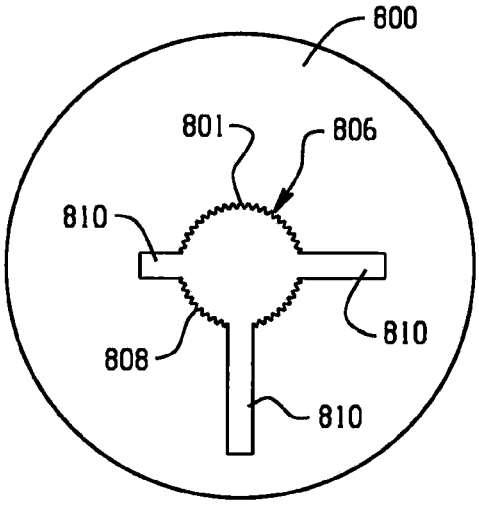

Referring to FIG. 8, a dispenser plate 800 includes an orifice 806 having a circular portion 808 and channels 810. In the illustrated embodiment, the circular portion 810 includes a serrated or toothed edge 801 that may facilitate the tearing of a sheet product segment from the roll 102 (of FIG. 1). The channels 910 have dissimilar lengths that extend radially from the circular portion 808.

Figure 9:
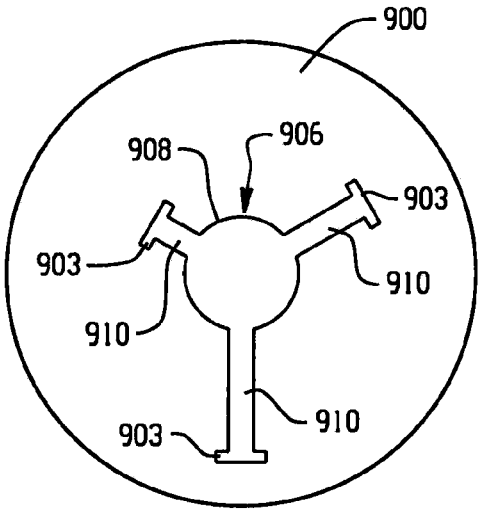

FIG. 9 illustrates a dispenser plate 900 that includes an orifice 906 having a circular portion 908 and channels 910. In the illustrated embodiment, the channels 910 are T-shaped and include terminal portions 903 arranged on the distal end of the channels 910 along an axis transverse to the linear axis of the channels 910. The channels 910 may have dissimilar lengths extending radially from the circular portion 908.

Figure 10:
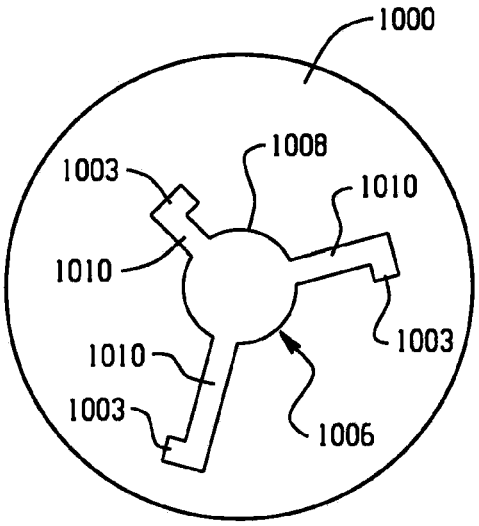

FIG. 10 includes a dispenser plate 1000 having an orifice 1006 with a circular portion 1008 and channels 1010. The channels 1010 are L-Shaped and include a bend forming distal end 1003 that is aligned at an oblique or right angle to the longitudinal axis (extending radially from the circular portion 1008) of the channels 1010.

Figure 11:
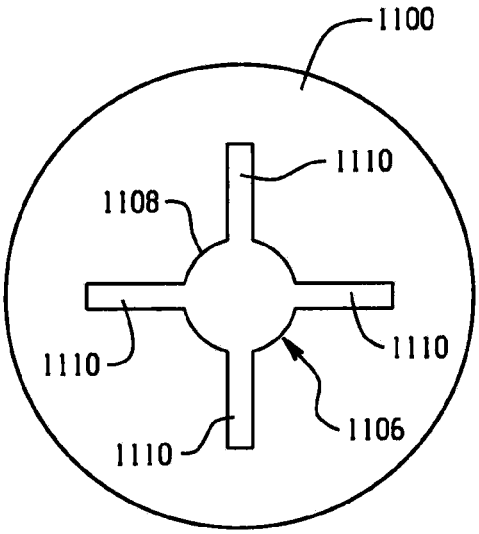

FIG. 11 illustrates a dispenser plate 1100 with an orifice 1106 having a circular portion 1108 and channels 1110. The channels 1110 extend radially from the circular portion 1101 and have similar lengths.

Figure 12:
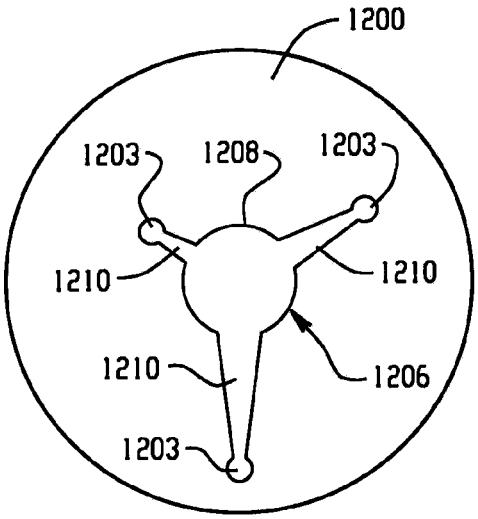

FIG. 12 illustrates a dispenser plate 1200 having an orifice 1206 including a circular portion 1208 and channels 1210. The channels 1210 extend radially from the circular portion 1208 and have a gradually decreasing or tapered width. The channels 1210 include circular terminal portion 1203 arranged at the distal ends of the channels 1210.

Figure 13:
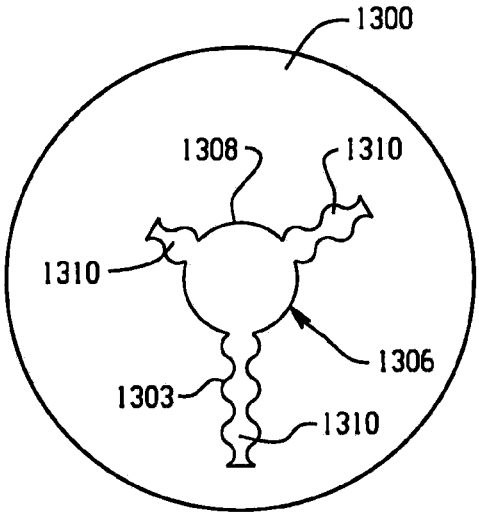

FIG. 13 includes a dispenser plate 1300 including an orifice 1306 having a circular portion 1308 and channels 1310. The channels 1310 include undulating or scalloped edges 1303. The channels 1310 extend radially from the circular portion 1308 and may include dissimilar lengths.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A dispenser plate for a roll of sheet product, the dispenser plate comprising:

a rigid plate member having an orifice centrally arranged in the plate member, the orifice including a central portion, a first channel portion having a first channel length extending radially from the central portion, and a second channel having a second channel length extending radially from the central portion, wherein the first channel length is greater than the second channel length, wherein the first and second channels each have a width such that a user may access the roll of sheet product through the channel.

2. The plate of claim 1, wherein the orifice further includes a third channel having a third channel length extending radially from the central portion.

3. The plate of claim 1, wherein the third channel length is greater than the first channel length.

4. The plate of claim 1, wherein the first channel and the second channel have an equal and uniform channel width.

5. The plate of claim 1, wherein the plate member has a circular outer edge.

6. The plate of claim 5, wherein the central portion of the orifice is arranged concentrically to circular outer edge of the plate member.

7. The plate of claim 1, wherein the first channel portion has an arcuate shaped profile.

8. The plate of claim 1, wherein the first channel portion has a serrated inner edge.

9. The plate of claim 1, wherein the circular portion has a serrated inner edge.

10. The plate of claim 1, wherein the first channel portion has a T-shaped terminal portion at a distal end of the first channel portion.

11. The plate of claim 1, wherein the first channel portion has an L-shaped terminal portion at a distal end of the first channel portion.

12. The plate of claim 1, wherein the first channel portion has a tapered profile and a circular shaped terminal portion at a distal end of the first channel portion.

13. The plate of claim 1, wherein the first channel portion has an undulating profile.

14. The plate of claim 1, wherein the central portion includes a circular shape.

15. A dispenser comprising:

a containment portion housing a cylindrical roll of sheet product; and a dispenser plate retained by the containment portion and disposed on an end surface of the cylindrical roll of sheet product, the dispenser plate comprising a rigid plate member having an orifice centrally arranged in the plate member, the orifice including a central portion, a first channel portion having a first channel length extending radially from the central portion, and a second channel having a second channel length extending radially from the central portion, wherein the first channel length is greater than the second channel length, wherein the first and second channels each have a width to allow a user to access the cylindrical roll of sheet product through the channel.

16. The dispenser of claim 15, wherein the orifice further includes a third channel having a third channel length extending radially from the central portion, wherein the third channel length is greater than the first channel length.

17. The dispenser of claim 16, wherein the containment portion comprises a wrapper, the wrapper enveloping the cylindrical roll of sheet product and the dispenser plate.

18. The dispenser of claim 15, wherein the dispenser plate is secured to an end portion of the cylindrical roll of sheet product.

19. The dispenser of claim 18, wherein the dispenser plate is secured to the end portion of the cylindrical roll of sheet product with a film, the film exerting a compressive force on the plate and the cylindrical roll of sheet product.

20. The dispenser of claim 15, wherein the cylindrical roll of sheet product has a removable inner core, the removable inner core having an inner core diameter smaller than an inner diameter of the central portion of the orifice, such that the inner core may be removed through the central portion by the user.

* * * * *